US005597981A

United States Patent [19]

Hinoshita et al.

[11] Patent Number: 5,597,981

[45] Date of Patent: Jan. 28, 1997

[54] UNSHIELDED TWISTED PAIR CABLE

[75] Inventors: Shinji Hinoshita; Akinari Nakayama; Kiyoshi Watanabe; Hideki Yagyu; Shinya Ishi; Shigeru Iwata, all of Hitachi, Japan

[73] Assignee: Hitachi Cable, Ltd., Tokyo, Japan

[21] Appl. No.: 398,566

[22] Filed: Mar. 3, 1995

[30] Foreign Application Priority Data

Nov. 9, 1994 [JP] Japan ..... 6-274944
Feb. 23, 1995 [JP] Japan ..... 7-035680

[51] Int. Cl.[6] ..... H01B 7/00

[52] U.S. Cl. ..... 174/110 R; 174/110 PM; 174/113 R

[58] Field of Search ..... 174/113 R, 110 FC, 174/110 R, 110 PM

[56] References Cited

U.S. PATENT DOCUMENTS

| | | | |
|---|---|---|---|
| 3,956,212 | 5/1976 | Sakaguchi et al. | 260/23 H X |
| 4,151,366 | 4/1979 | Betts et al. | 174/116 X |
| 4,268,433 | 5/1981 | Sawatari et al. | 525/193 X |
| 4,389,516 | 6/1983 | Sugio et al. | 525/534 X |
| 4,969,706 | 11/1990 | Hardin et al. | 350/96.23 |
| 5,001,304 | 3/1991 | Hardin et al. | 174/107 |
| 5,124,404 | 6/1992 | Atwell et al. | 525/72 X |
| 5,159,015 | 10/1992 | Hamersma et al. | 525/68 X |
| 5,162,609 | 11/1992 | Adriaenssens et al. | 174/34 |
| 5,358,786 | 10/1994 | Ishikawa et al. | 428/380 X |
| 5,358,989 | 10/1994 | Casarini et al. | 524/360 X |
| 5,360,887 | 11/1994 | Tsunemi et al. | 528/97 X |
| 5,378,539 | 1/1995 | Chen | 428/378 X |

FOREIGN PATENT DOCUMENTS

| | | | |
|---|---|---|---|
| 60-501215 | 8/1985 | Japan . | |
| 2301911 | 12/1990 | Japan | 350/96.23 |
| 3141510 | 6/1991 | Japan | 174/107 |
| 660740 | 3/1994 | Japan . | |

*Primary Examiner*—Kristine L. Kincaid
*Assistant Examiner*—Chau N. Nguyen
*Attorney, Agent, or Firm*—Helfgott & Karas, PC.

[57] ABSTRACT

In an unshielded twisted pair cable, a predetermined number of pairs which are twisted by a predetermined lay-length are covered by a protective sheath. Insulations for insulating conductors for the pairs and the protective sheath are wholly or partially of halogen free polymer having a low dielectric loss tangent and flame-retarding properties. The insulations have a dielectric loss tangent of less than $1\times10^{-2}$ at 150 MHz and a 2% modulus of at least 0.3 kgf/mm$^2$.

16 Claims, 5 Drawing Sheets

UNSHIELDED TWISTED PAIR CABLE

FIELD OF THE INVENTION

The invention relates to an unshielded twisted pair cable, and more particularly to, an unshielded twisted pair cable which is adapted to the transmission of high speed digital signals.

BACKGROUND OF THE INVENTION

In general, unshielded twisted pair cables each comprising a predetermined number of insulated conductor-pairs (defined "pairs" hereinafter) stranded by a predetermined lay-length and a protective sheath covering the stranded pairs are used in a LAN (Local Area Network) system. The unshielded twisted pair cables are installed in a building vertically floor to floor, or horizontally in spaces of ceilings, that is, plenums without using metal conduits.

In such installation state, there is a possibility in which the unshielded twisted pair cables carry fire in case where a fire spread out in a building. Therefore, the unshielded twisted pair cable is required to have flame-retarding properties.

A conventional unshielded twisted pair cable comprises a predetermined number of pairs insulated with polyethylene or fluorine resin, and a protective sheath of polyvinyl chloride (PVC) covering the pairs, wherein the fluorine resin insulations and the PVC sheath provide flame-retarding properties.

In the conventional unshielded twisted pair cable, however, there are disadvantages in that smoke and harmful gases including halogen gases such as hydrogen chloride, hydrogen fluoride, etc. are generated from the insulated pairs and the protective sheath at the time of fire, so that human bodies are badly affected, evacuation and extinguishing activities are obstructed due to the hindered views, and a computer network, a communication equipment, etc. are deteriorated by corrosive gases. There is a further disadvantage in the conventional unshielded twisted pair cable in that a high frequency leakage current flows through the sheath to increase a transmission loss at a high frequency band, because the pairs are not shielded under the situation where the transmission of high speed digital signals ranging 10 Mb/s to 100 Mb/s (TPDDI LAN) is required in accordance with the requirement of high speed LAN systems in recent years. Furthermore, conventional unshielded twisted pair cables have the fluctuation of transmission characteristics, and the difference of laying condition. This problem is caused that these cables are laid in a buildings under various conditions as described above.

SUMMARY OF THE INVENTION

Accordingly, it is an object of the invention to provide an unshielded twisted pair cable, from which colored and harmful gases are not generated at the time of fire.

It is a further object of the invention to provide an unshielded twisted pair cable, from which corrosive gases are not generated.

It is a still further object of the invention to provide an shielded twisted pair cable, in which a transmission loss is suppressed at a high frequency band.

According to the first feature of the invention, an shielded twisted pair cable, comprises:

a predetermined number of pairs stranded by a predetermined lay-length, each pair being twisted and comprising a conductor and an insulation provided to insulate the conductor, the insulation being of poly(phenylene oxide) at least at an outer portion thereof; and a protective sheath for covering the pairs, the protective sheath being of poly(phenylene oxide).

According to the second feature of the invention, an shielded twisted pair cable, comprises:

a predetermined number of pairs stranded by a predetermined lay-length, each pair being twisted and comprising a conductor and an insulation provided to insulate the conductor, the insulation having a dielectric loss tangent of less than $1\times10^{-2}$ at a frequency of 150 MHz and a 2% modulus of at least 0.3 kgf/mm$^2$; and a protective sheath for covering the pairs.

According to the third feature of the invention, an shielded twisted pair cable, comprises:

a predetermined number of pairs stranded by a predetermined lay-length, each pair being twisted and comprising a conductor and an insulation provided to insulate the conductor, the insulation being of non-halogen flame-retarding composition, and having a dielectric loss tangent of less than $1\times10^{-2}$ at a frequency of 150 MHz and a 2% modulus of at least 0.3 kgf/mm$^2$; and a protective sheath being of non-halogen flame-retarding composition for covering the pairs.

According to the fourth feature of the invention, an shielded twisted pair cable, comprises:

a predetermined number of pairs stranded by a predetermined lay-length, each pair being twisted and comprising a conductor and an insulation provided to insulate the conductor; and a protective sheath for covering the pairs, the protective sheath being of a composition comprising a polymer and a flame-retarding agent, the composition having a dielectric loss tangent of $7\times10^{-4}$ to $7\times10^{-3}$.

BRIEF DESCRIPTION OF THE DRAWINGS

The invention will be explained in more detail in conjunction with appended drawings, wherein.

DESCRIPTION OF THE PREFERRED EMBODIMENTS

Figure 1:
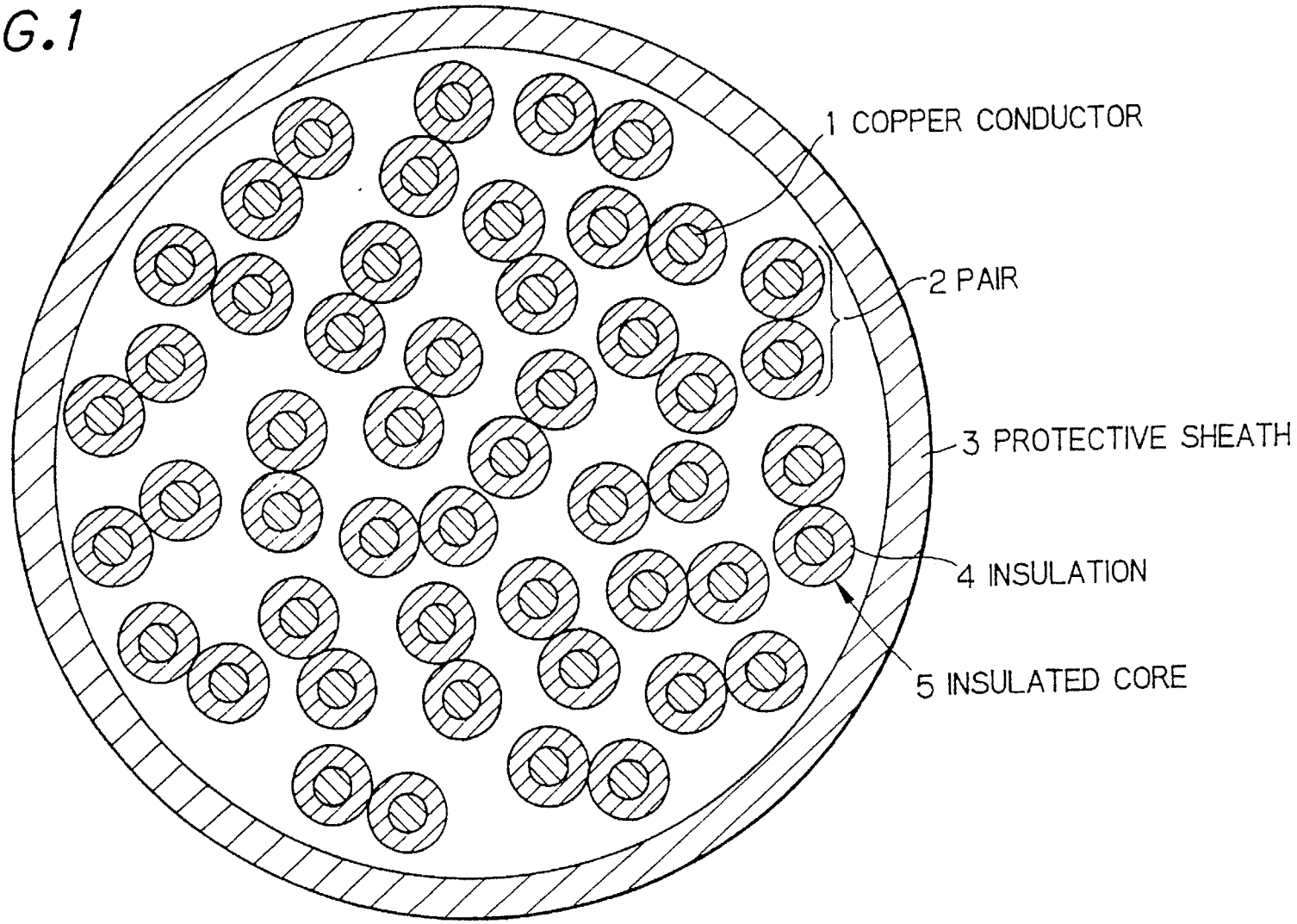
FIG. 1 is a cross-sectional view showing a first structure of an shielded twisted pair cable in which preferred embodiments according to the invention are implemented.

Before explaining an shielded twisted pair cable in the preferred embodiment according to the invention, materials used in the invention will be explained.

In the first feature of the invention, poly(phenylene oxide) is expressed by a general chemical formula as defined below, and has a dielectric loss tangent of $\mathbf{6\times10^{-4}}$ (0.06%) at a frequency of 150 MHz, wherein $R_1$ to $R_4$ represent hydrogen or alkyd group.

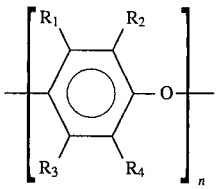

Polymers of low dielectric loss tangents and flame-retarding properties are ones having a dielectric loss tangent of less than 0.7% at a frequency of 150 MHz, and flame-retarding properties of "V–0" or "V–1" under the standard of "UL (Underwriters Laboratories) 94" on the flame tests for plastic materials, and may be one or more of poly(ether imide), poly(ether sulfone), poly(phenylene sulfide), poly(phenylene oxide), maleic anhydride-modified poly(phenylene oxide), silicone resin, poly(ether ether ketone), etc.

Ethylene-polymers may be one or more of polyethylene, ethylene-vinylacetate copolymer, ethylene-propylene copolymer, ethylene-butene-1 copolymer, ethylene-methylacrylate copolymer, ethylene-glycidyl methacrylate copolymer, ethylene-maleic anhydride copolymer, ethylene-methylmethacrylate copolymer, etc.

Styrene-polymers may be one or more of styrene-ethylene-butylene-styrene-triblock copolymer, styrene-ethylene-butylene-diblock copolymer, etc. which are used as a interfacual agent for the etylene-polymer and the polymer of the low dielectric loss tangent and flame-retarding properties.

One or at least two of phosphorus compound, metal hydroxide compound, metal oxide compound, etc. may be used as a flame-retarding agent for the above described compositions.

The phosphorus compound may be one or more of red phosphorus, phosphate ester such as triphenyl phosphate, phosphonate, phospholinen, etc.

The metal hydroxide compound may be one or more of aluminum hydroxide, magnesium hydroxide, calcium aluminate hydrate, calcium hydroxide, tin hydroxide barium hydroxide, hard-cray, etc. And the surface of these compounds may be treated to improve their water resisting properties with fatty acid or its metallic salt or silane (or titanate) coupling agent.

The metal oxide compound may be one or more of antimony oxide, tin oxide, molybdenum oxide, zirconium oxide, etc.

The above described composition may be mixed with antioxidant, lubricant, compatibilizer, coloring agent, softening agent, and plasticizer, inorganic filler, and, if necessary, cross-linked by chemical cross-linking using organic peroxide, silane graft water cross-linking, irradiation cross-linking using ionizing radiation, etc. Non-halogen flame-retarding composition is the composition of polymer having aromatic ring in its main chain containing poly(phenylene oxide) and polymer having siloxan and/or unit polymerized and 0~300 parts by weight of non-halogen flame-retarding agent or polymer having unit polymerized with olefin and 1~300 parts by weight of non-halogen flame-retarding agent.

In the second and third features of the invention, poly(phenylene oxide) is the same one as explained in the first feature of the invention.

Polymer having aromatic ring in its main chain may be one or more of polyimide, poly(etherimide), poly(phenylene sulfide), poly(ether sulfone), polycarbonate, poly(ether imide)-silicon coplymer, poly(etheylene terephthalate), aromatic polyamide, polyarylate, maleic anhydride-modified poly(phenylene oxide), poly(ether ether ketone), etc., in addition to the above described poly(phenylene oxide).

Polymer having unit polymerized with olefine may be one or more of various olefine polymers such as polyethylene, polypropylene, polybutene, poly-4-methylpentene-1, ethylene-vinylacetate copolymer, ethyleneethylacrylate copolymer, ethylene-propylene copolymer, ethylene-butene-1 copolymer, ethyleneene-mathylacrylate copolymer, ethylene-glycidyl methacrylate copolymer, ethylene-maleic anhydride copolymer, ethylene-methylmethacrylate copolymer, styrene-ethylene-butylene-styrenetriblock copolymer, styrene-ethylene-butylendiblock copolymer, styrene-ethylen-propylene-styrenetriblock copolymer, styrene-ethylene-propylendiblock copolymer, etc.

Polymer having siloxane in its main chain may be one or more of poly(dimethyl siloxene), poly(methyl vinyl siloxene), poly(methyl phenyl siloxene), etc.

Non-halogen flame-retarding agent is the same one as explained in the first feature of the invention.

The above described composition may be mixed with the same additives as explained in the first feature of the invention, and, if necessary, cross-linked in the same manner as explained in the first feature of the invention.

The above described composition may be foamed for insulations of an shielded twisted pair cable by gas foaming using nitrogen gas, chemical foaming using azodicarbon amide, etc.

As a result of setting dielectric loss tangents at a high frequency band for compositions of insulations of pairs and a protective sheath of an shielded twisted pair cable to be less than predetermined values which are specified in the second and third features of the invention, the deterioration of high speed digital signal transmission characteristics resulted from the flame-retardation of the cable can be Largely suppressed.

As a result of setting moduluses of the compositions of the insulations and the protective sheath to be less than predetermined values which are also specified in the second and third features of the invention, high resistance to the distortion and the bending of the cable induced dependent on the installation state thereof is assigned to the cable. Consequently, the proximity of the insulated conductors and the increase of capacitances caused by the collapse of the cable structure and the deformation of the insulations are avoided to suppress the fluctuation of transmission characteristics of the cable. For this reason, it is possible to provide a transmission line of unshielded twisted pair cables which is stable without dependency of the installation state of the cables.

In a cable comprising insulations and a protective sheath which are formed with polymer having aromatic ring in its main chain such as polyphenylene oxide, etc., the aromatic-group polymer has a property in which it is rapidly carbonized at fire to provide high flame-retarding properties.

On the other hand, polymer having olefine-polymerized unit in its main chain, or siloxene-bond in its main chain provides better forming or extruding, elongation, and dielectric characteristics for a composition.

Consequently, the composition comprising the aromatic-group polymer and the olefine-polymerized unit or siloxene-bond containing polymer is suitable for fabrication of an shielded twisted pair cable having high flame-retarding properties and a low transmission loss at a high frequency band.

Next, an shielded twisted pair cable in the preferred embodiments according to the invention will be explained.

FIG. 1 shows a first structure of the unshielded twisted pair cable in which the preferred embodiments are implemented.

The unshielded twisted pair cable comprises 25 pairs 2 each comprising a pair of insulated cores 5 each comprising a copper conductor 1 having a diameter of 0.5 mm and an insulation 4 having a thickness of 0.25 mm, and a protective sheath 3 having a thickness of 0.7 mm covering the pairs 2 stranded with a predetermined lay-length.

In manufacturing the unshielded twisted pair cable, the insulations 4 are extruded on the copper conductors 1 at a temperature of 200° to 400° C. by a 19 mm-extruder. Then, the insulated cores 5 are twisted with the predetermined lay-length to provide the pairs 2, which are then put together into stranded pairs. Thereafter, the stranded pairs 2 are covered with the protective sheath 3 with extrusion.

In this manner, 25 kinds of unshielded twisted pair cables are manufactured as shown in Tables 1 and 2. At the same time, sample sheets each having a thickness of 0.5 mm are prepared at a temperature of 250° to 350° C. with use of the compositions as shown in Tables 1 and 2 by an electric heater press.

TABLE 1

| COMPOSITION BY WEIGHT | | | | | | | | | | | | | |
|---|---|---|---|---|---|---|---|---|---|---|---|---|---|
| | PREFERRED EMBODIMENT | | | | | | | | | | | | |
| COMPONENT | 1 | 2 | 3 | 4 | 5 | 6 | 7 | 8 | 9 | 10 | 11 | 12 | 13 |
| INSULATION | | | | | | | | | | | | | |
| POLY(PHENYLENE OXIDE)*1 | 100 | 100 | | | 95 | 95 | 60 | 60 | 60 | 30 | 30 | 30 | |
| POLY(ETHER IMIDE)*2 | | | 100 | 100 | | | | | | | | | 60 |
| POLYAMIDE 6*3 | | | | | | | | | | | | | |
| POLY(METHYL METHACRYLATE)*4 | | | | | | | | | | | | | |
| LOW DENSITY POLY-ETHYLENE*5 | | | | | 5 | 5 | 40 | 40 | 40 | 70 | 70 | 70 | 40 |
| MAGNESIUM HYDROXIDE*6 | | | | | | | | 30 | | | 50 | | 30 |
| TRIPHENYLPHOSPHATE | | 10 | | 10 | | | | | 10 | | | 10 | |
| PROTECTIVE SHEATH | COMPOSITION OF PREFERRED EMBODIMENT 1 | | | | COMPOSITION OF PREFERRED EMBODIMENT 8 | | | | | | | | |
| EVALUATION | | | | | | | | | | | | | |
| NON-GENERATION OF HYDROGEN HALOGENIDE | ○ | ○ | ○ | ○ | ○ | ○ | ○ | ○ | ○ | ○ | ○ | ○ | ○ |
| FLAME RETARDATION | E | E | E | E | E | E | E | E | E | G | E | E | E |
| ELONGATION (%) | 52 | 55 | 60 | 58 | 80 | 110 | 320 | 220 | 360 | 490 | 340 | 510 | 310 |
| tan δ (%) | 0.04 | 0.13 | 0.31 | 0.43 | 0.04 | 0.13 | 0.03 | 0.05 | 0.11 | 0.02 | 0.04 | 0.10 | 0.05 |

| | COMPARISON | | | | | | |
|---|---|---|---|---|---|---|---|
| COMPONENT | 1 | 2 | 3 | 4 | 5 | 6 | 7 |
| INSULATION | | | | | | | |
| POLY(PHENYLENE OXIDE)*1 | | | | | | | |
| POLY(ETHER IMIDE)*2 | | | | | | | |
| POLYAMIDE 6*3 | | 100 | 100 | | | 60 | 60 |
| POLY(METHYL METHACRYLATE)*4 | | | | 100 | 100 | | |
| LOW DENSITY POLYETHYLENE*5 | 100 | | | | | 40 | 40 |
| MAGNESIUM HYDROXIDE*6 | | | | | | 30 | |
| TRIPHENYLPHOSPHATE | | | 10 | | 10 | | 10 |
| PROTECTIVE SHEATH | PVC | COMPOSITION OF PREFERRED EMBODIMENT 1 | | | | COMPOSITION OF PREFERRED EMBODIMENT 8 | |
| EVALUATION | | | | | | | |
| NON-GENERATION OF HYDROGEN HALOGENIDE | x | ○ | ○ | ○ | ○ | ○ | ○ |
| FLAME RETARDATION | E | B | B | B | B | B | B |
| ELONGATION (%) | 630 | 250 | 230 | 5 | 3 | 150 | 180 |
| tan δ (%) | 0.01 | 3.03 | 3.15 | 2.08 | 3.17 | 2.81 | 2.62 |

TABLE 2

| COMPOSITION BY WEIGHT | | | | | | | | | | | | | | | | |
|---|---|---|---|---|---|---|---|---|---|---|---|---|---|---|---|---|
| | PREFERRED EMBODIMENT | | | | | | | | | | | | COMPARISON | | | |
| COMPONENT | 14 | 15 | 16 | 17 | 18 | 19 | 20 | 21 | 22 | 23 | 24 | 25 | 8 | 9 | 10 | 11 |
| INSULATION | | | | | | | | | | | | | | | | |
| POLY(PHENYLENE OXIDE) | 95 | 95 | 95 | 60 | 60 | 60 | 60 | 60 | 60 | 30 | 30 | 30 | | | | |
| POLYAMIDE 6 | | | | | | | | | | | | | 60 | 60 | | |
| POLY(METHYL METHACRYLATE) | | | | | | | | | | | | | | | 60 | 60 |
| LOW DENSITY POLYETHYLENE | 5 | 5 | 5 | 40 | 40 | 40 | 40 | 40 | 40 | 70 | 70 | 70 | 40 | 40 | 40 | 40 |
| STYRENE-ETHYLENE-BUTYLENE-STYRENE TRI-BLOCK COPOLYMER | 3 | 20 | 50 | 3 | 3 | 20 | 20 | 50 | 50 | 3 | 20 | 50 | 20 | 20 | 20 | 20 |
| TRIPHENYLPHOSPHATE | | | | | 10 | | 10 | | 10 | 10 | 10 | 10 | | 10 | | 10 |
| PROTECTIVE SHEATH | COMPOSITION OF PREFERRED EMBODIMENT 20 | | | | | | | | | | | | | | | |
| EVALUATION | | | | | | | | | | | | | | | | |
| NON-GENERATION OF HYDROGEN HALOGENIDE | ○ | ○ | ○ | ○ | ○ | ○ | ○ | ○ | ○ | ○ | ○ | ○ | ○ | ○ | ○ | ○ |
| FLAME RETARDATION | E | E | E | E | E | E | E | G | G | E | G | G | B | B | B | B |
| ELONGATION (%) | 90 | 150 | 230 | 350 | 380 | 410 | 440 | 520 | 570 | 580 | 720 | 850 | 240 | 220 | 40 | 35 |
| tan δ (%) | 0.04 | 0.04 | 0.03 | 0.03 | 0.11 | 0.05 | 0.16 | 0.04 | 0.13 | 0.10 | 0.12 | 0.11 | 23.41 | 2.54 | 1.62 | 1.87 |

In Tables 1 and 2, the reference numerals and letters indicate as follows.
*[1]Intrinsic viscosity [η] = 0.46 I.V. (chloroform 25° C.): GE PLASTICS
*[2]Ultem 1000: GE PLASTICS
*[3]Novamide 1020 J: MITSUBISHI CHEMICAL
*[4]Acrylight S: MITSUBISHI RAYON
*[5]Mirason 3530: MITSUI PETRO CHEMICAL INDUSTRIES
*[6]Kisuma 5A: KYOWA CHEMICAL INDUSTRY
E: Excellent
G: Good
B: Bad The unshielded twisted pair cables thus manufactured and the sample sheets thus prepared are tested in regard to flame-retarding properties, tensile elongation, and dielectric loss tangent (tan δ). A method of testing the flame-retarding properties is based on IEEE standard 383, wherein a prescribed number of cables having a length of 2.4 m are arranged vertically to receive flame of 70.000 BTU/h which is positioned 0.6 m below the lower ends of the cables for 20 minutes, and the flame is removed therefrom to check the flame-retarding properties of the cables. In this test, when a fire is self-extinguished in the cables with a fire extension length less than 1.8 m, the cables are judged to pass the test. On the other hand, when a fire extension length is more than 1.8 m in the cables, the cables are judged to fail the test. A further test is carried out on the basis of JIS 3005, 28 (2), wherein the insulated cores are inclined to be fired. In this test, when a fire is self-extinguished in the insulated cores without fire extension, the cables are judged to pass the test. On the other hand, the fire is extended along the insulated cores, the cables are judged to fail the test.

In accordance with the results of the two tests, the cables having passed both of IEEE standard 383 and JIS 3005, 28(2) or only IEEE383 are marked "E", and the cables having passed only JIS 3005, 28(2) are marked "G".

On the other hand, the cables having failed the both standards are marked "B".

The test of non-generation of hydrogen halogenide is carried out on the basis of JCS (Japan Cable Industries Standards), C, No. 53.

The test of tensile elongation is carried out by the steps of withdrawing the copper conductor 1 out of the insulated core 5, and placing the tube-shaped insulation 4 on a tensile test equipment. In this test, a tensile elongation is measured under a tensile speed of 200 mm/min, wherein the insulation 4 having an elongation of more than 300% is judged to be excellent, while the insulation 4 having an elongation of less than 50% is judged to fail the test.

The dielectric loss tangent (tan δ) is measured in a parallel plate method at a frequency of 150 MHz with use of impedance analyzer manufactured by YHP by using the sample sheets as previously explained. When tan δ is more than $7\times10^{-3}$ (0.7%), the measured sheet is judged to fail the test.

In accordance with the tests as described above, the preferred embodiments 1 to 25 have indicated excellent flame-retarding properties, tensile elongation, and dielectric characteristics, and have generated no hydrogen halogenide.

In the comparison example 2 to 11 using poly(methyl methacrykate) and polyamide 6 in place of polymer of the low dielectric loss tangent and flame-retarding properties used in the preferred embodiments, however, at least one of the flame-retarding properties, tensile elongation and dielectric loss tangent is judged to be bad. In addition, harmful hydrogen chrolide gas is generated in the comparison example 1.

Figure 2:
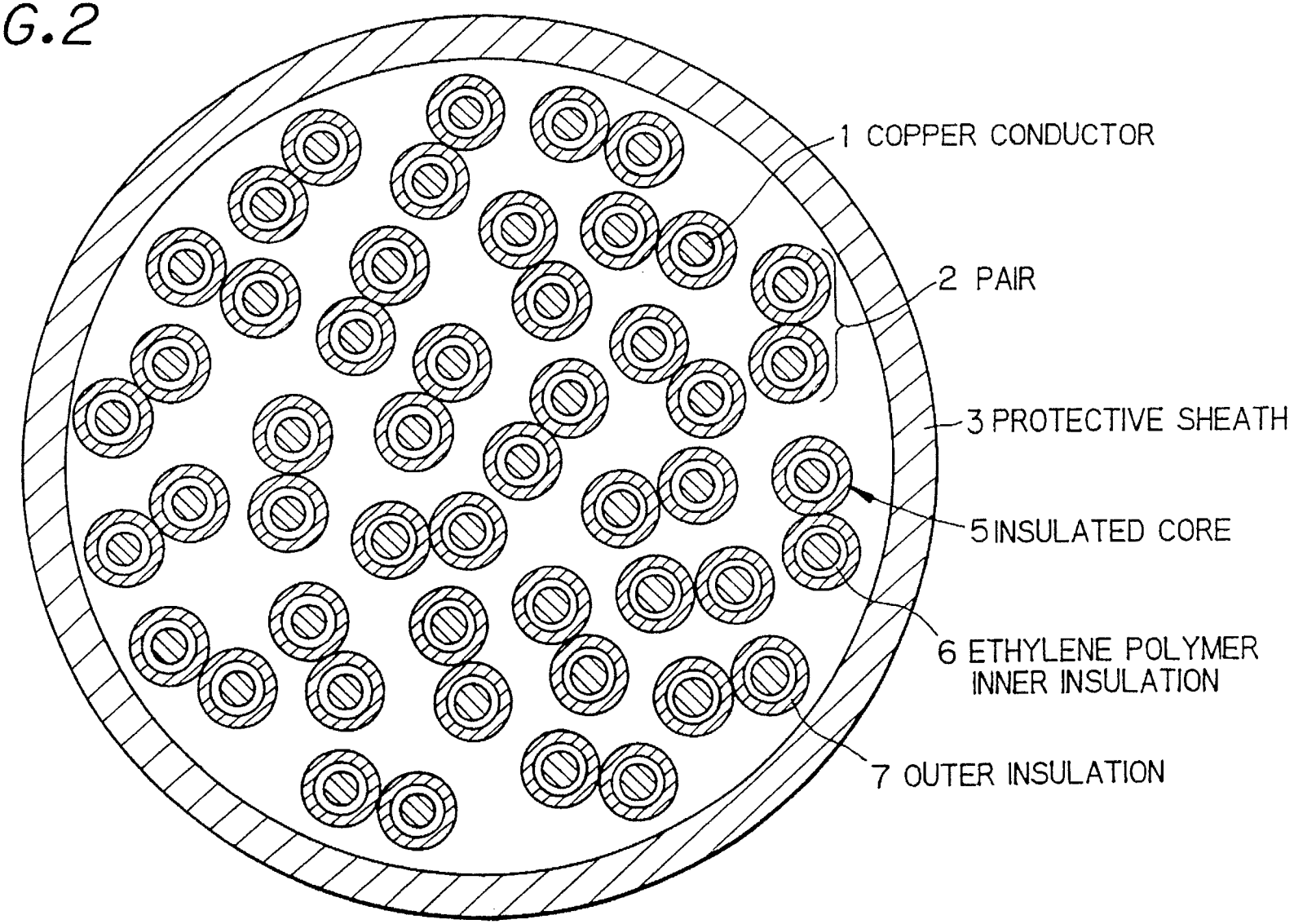
FIG. 2 is a cross-sectional view showing a second structure of an shielded twisted pair cable in which preferred embodiments according to the invention are implemented,.

FIG. 2 shows a second structure of the unshielded twisted pair cable in which the preferred embodiments are implemented.

In FIG. 2, like parts are indicated by like reference numerals as used in FIG. 1, provided that the insulation 4 is replaced by an ethylene polymer inner insulation 6 and an outer insulation 7.

In the unshielded twisted pair cable as shown in FIG. 2, the outer insulation 7 and the protective sheath 3 are formed by one or more selected from the preferred embodiments 1 to 25 as shown in Tables 1 and 2.

In the same manner as explained before, unshielded twisted pair cables are manufactured, and sample sheets are prepared. The unshielded twisted pair cables thus manufactured and the sample sheets thus prepared are tested to provide the results as indicated in Tables 3 to 5.

TABLE 3

| COMPOSITION BY WEIGHT | | | | | | | |
|---|---|---|---|---|---|---|---|
| | PREFERRED EMBODIMENT | | | | | | |
| COMPONENT | 26 | 27 | 28 | 29 | 30 | 31 | 32 |
| INSULATION | | | | | | | |
| POLY(PHENYLENE OXIDE)*1 | 50 | 60 | 60 | — | 60 | — | — |
| POLY(ETHER IMIDE)*2 | — | — | — | 60 | — | 60 | — |
| POLY(DIMETHYL SILOXENE)*3 | — | — | 10 | — | — | — | — |
| LOW DENSITY POLYETHYLENE*4 | 30 | — | — | 40 | — | 40 | 100 |
| STYRENE-ETHYLENE-BUTYLENE-STYRENE TRIBLOCK COPOLYMER*5 | 20 | 40 | 30 | — | 40 | — | — |
| MAGNESIUM HYDROXIDE*7 | — | — | — | — | — | 70 | 100 |
| TRIPHENYLPHOSPHATE | — | — | — | — | 10 | — | — |
| ANTIOXIDANT*8 | 0.5 | 0.5 | 0.5 | 0.5 | 0.5 | 0.5 | 0.5 |
| PROTECTIVE SHEATH | COMPOSITION OF COMPARISON EXAMPLE 13 | | | | | | |
| EVALUATION | | | | | | | |
| tan δ (%) | 0.04 | 0.05 | 0.07 | 0.19 | 0.12 | 0.73 | 0.08 |
| TRANSMISSION LOSS α | ○ | ○ | ○ | ○ | ○ | ○ | ○ |
| 2% MODULUS (kgf/mm$^2$) | 1.22 | 2.07 | 1.88 | 3.16 | 1.97 | 4.31 | 0.55 |
| TRANSMISSION LOSS α AFTER BENDING TEST | ○ | ○ | ○ | ○ | ○ | ○ | ○ |
| FLAME-RETARDATION | ○ | ○ | ○ | ○ | ○ | ○ | ○ |
| NON-GENERATION OF HYDROGEN HALOGENIDE AT FIRE | ○ | ○ | ○ | ○ | ○ | ○ | ○ |
| TOTAL EVALUATION | ○ | ○ | ○ | ○ | ○ | ○ | ○ |

TABLE 4

| COMPOSITION BY WEIGHT | | | | | | |
|---|---|---|---|---|---|---|
| | PREFERRED EMBODIMENT | | | | | |
| | 33 | | 34 | | 35 | |
| COMPONENT | OUTER INSULATION | INNER INSULATION | OUTER INSULATION | INNER INSULATION | OUTER INSULATION | INNER INSULATION |
| INSULATION | | | | | | |
| POLY(PHENYLENEOXIDE)*1 | 60 | — | — | — | 60 | — |
| LOW DENSITY POLYETHYLENE*4 | — | 100 | — | 100 | — | 100 |
| STYRENE-ETHYLENE-BUTYLENE-STYRENE TRIBLOCK COPOLYMER*5 | 40 | — | — | — | 40 | — |
| POLYPROPYLENE*6 | — | — | 100 | — | — | — |
| MAGNESILM HYDROXIDE*7 | — | — | — | 100 | — | 300 |
| TRIPHENYLPHOSPHATE | 10 | — | — | — | 10 | — |
| ANTIOXIDANT*8 | 0.5 | — | — | 0.5 | 0.5 | 0.5 |
| PROTECTIVE SHEATH | COMPOSITION OF COMPARISON EXAMPLE 13 | | | | | |
| EVALUATION | | | | | | |
| tan δ (%) SEPARATELY | 0.05 | 0.02 | 0.04 | 0.06 | 0.12 | 0.81 |
| TOTALLY | | 0.04 | | 0.05 | | 0.58 |
| TRANSMISSION LOSS α | | ○ | | ○ | | ○ |
| 2% MODLLUS (kgf/mm$^2$) | | 1.12 | | 0.84 | | 1.37 |

TABLE 4-continued

| | COMPOSITION BY WEIGHT | | |
|---|---|---|---|
| TRANSMISSION LOSS α AFTER BENDING TEST | ○ | ○ | ○ |
| FLAME-RETARDANT | ○ | ○ | ○ |
| NON-GENERATION OF HYDROGEN HALOGENIDE AT FIRE | ○ | ○ | ○ |
| TOTAL EVALUATION | ○ | ○ | ○ |

TABLE 5

| | COMPARISON | | | | |
|---|---|---|---|---|---|
| COMPONENT | 12 | 13 | 14 | 15 | 16 |
| INSULATION | | | | | |
| POLY(PHENYLENE OXIDE)*1 | 50 | — | 20 | — | — |
| LOW DENSITY POLYETHYLENE*4 | — | 100 | — | 100 | 100 |
| STYRENE-ETHYLENE-BUTYLENE-STYRENE TRIBLOCK COPOLYMER*5 | 50 | — | 80 | — | — |
| MAGNESIUM HYDROXIDE | 350 | 350 | — | — | — |
| TRIPHENYLPHOSPHATE | 10 | — | — | — | — |
| ANTIOXIDANT | 0.5 | 0.5 | 0.5 | — | — |
| PROTECTIVE SHEATH | COMPOSITION OF COMPARISON EXAMPLE 13 | | | LOW DENSITY POLYETHYLENE | PVC |
| EVALUATION | | | | | |
| tan δ (%) | 1.25 | 1.05 | 0.03 | 0.02 | 0.02 |
| TRANSMISSION LOSS α | x | x | ○ | ○ | ○ |
| 2% MODULUS (kgf/mm$^2$) | 2.57 | 0.82 | 0.27 | 0.21 | 0.21 |
| TRANSMISSION LOSS α AFTER BENDING TEST | x | x | x | x | x |
| FLAME-RETARDATION | ○ | ○ | ○ | x | ○ |
| NON-GENERATION OF HYDROGEN HALOGENIDE AT FIRE | ○ | ○ | ○ | ○ | x |
| TOTAL EVALUTION | x | x | x | x | x |

In Tables 3 to 5, the reference numbers indicate as follows.
*1Intrinsic viscosity [η] = 0.46 I.V. (chloroform 25° C.): GE PLASTICS
*2Ultem 1000: GE PLASTICS
*3KE-76: SHINETSU CHEMICAL
*4Mirason 3530: MITSUI PETRO CHEMICAL INDUSTRIES
*5Kraton G-1652: SHELL CHEMICAL COMPANY
*6Density 0.89 Melt Index 1.0
*7Kisuma 5A: KYOWA CHEMICAL INDUSTRY
*8Irganox 1010: CIBA-GEIGY In obtaining the results as indicated in Tables 3 to 5, the measurement is carried out as follows.

(a) The tan δ is measured in a parallel plate method at a frequency of 150 MHz with use of an impedance analyzer manufactured by Yokogawa hewlett packard by using the sample sheets as previously prepared.

(b) The transmission loss a is measured all of the pairs 2 at a frequency band of 0.064 to 100 MHz with use of a network analyzer manufactured by Yokogawa hewlett packard. When the whole pairs 4 provide a loss of less than a value calculated expressed by the below equation, the pairs 2 are judged to pass the test.

$$\alpha(db/100m)=1.967\sqrt{f}+0.023f+0.050/\sqrt{f}$$

where f is a frequency (MHz).

On the other hand, when at least one of the pairs 2 provides a loss of greater than the value calculated by the above equation, the pairs 2 are judged to fail the test.

Figure 3:
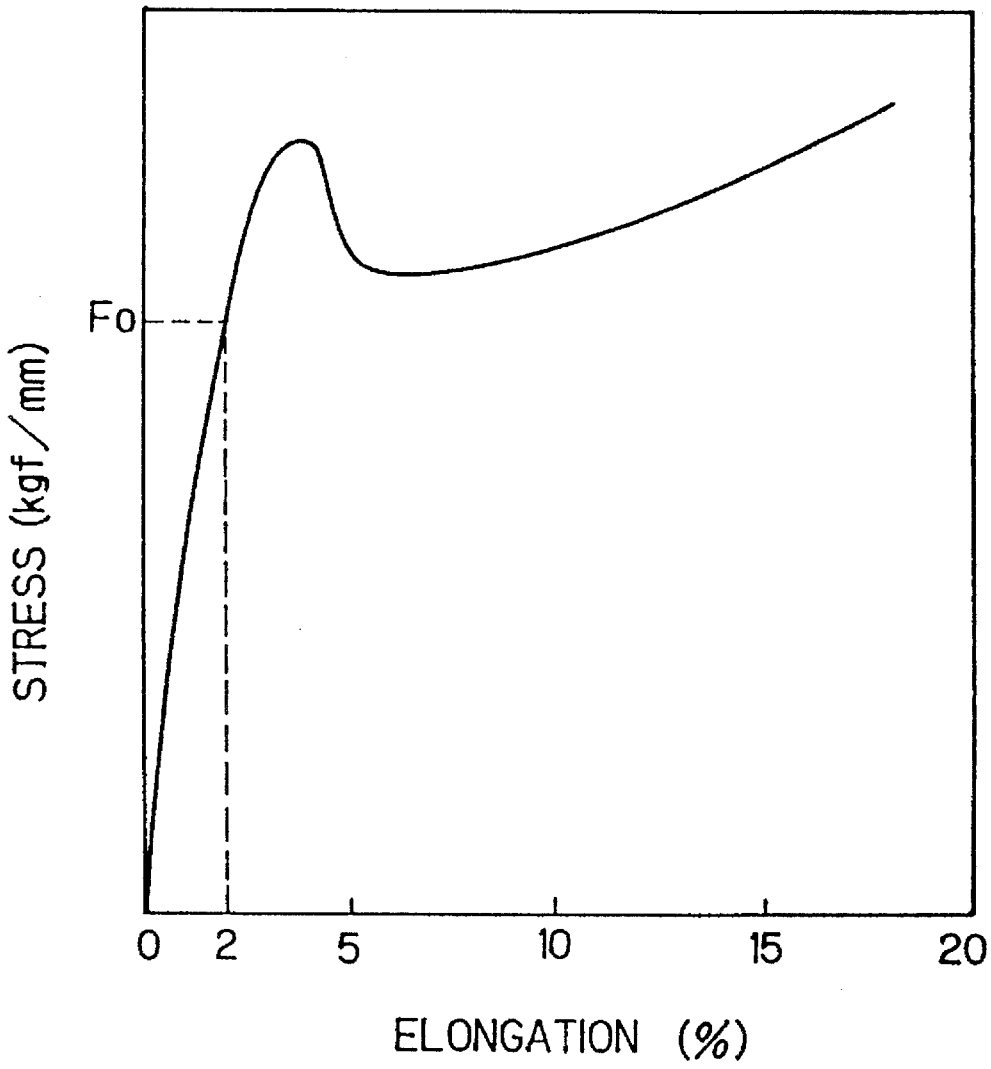
FIG. 3 is a graph showing a stress relative to an elongation of a material used in the preferred embodiments.

(c) The 2% modulus is measured for the insulation 4 from which the copper conductor 1 is withdrawn on the basis that the insulation 4 is applied with a tension with a tensile speed of 10 mm/min by using pair holding chucks having an initial interval of 50 mm. FIG. 3 shows a stress (kgf/mm$^2$) relative to an elongation (%), wherein the stress is Fo, when the elangation is 2%.

(d) The transmission loss after the bending test is measured for all of the pairs 2. A cable is bent on a mandrel having a diameter of 140 mm which is equal to ten times of a diameter of the cable, and is restored to be straight from the bending state to finish one cycle of 10 seconds in the bending test. Thus, 1,000 cycles are carried out at 20 points which are located with intervals of more than 3 m along each cable having a length of 100 m. After finishing the bending test, the transmission loss a is measured for all of the pairs 2. Then, when the transmission loss α is less than a value of the equation defined in the item (b), the cable is judged to pass the test as marked "o" in Tables 3 to 5. On the other hand, when the transmission loss α is greater than the value of the equation, the cable is judged to fail the test as marked "x" in Tables 3 to 5.

(e) The flame-retarding test and the hydrogen halogenide generation test are carried out on the basis of IEEE standard 383 and JCS standard C, No. 53, respectively, which have been explained in regard to Tables 1 and 2.

In accordance with the tests as described above, the comparison example 1~5 have indicated bad properties of transmission characteristics before and/or after bending test or flame-retardation or have hydrogen halogenide, however, the preferred embodiments 1~10 have indicated excellent transmission characteristics before and after bending test, flame-retardation and have no hydrogen halogenide.

In the first feature of the invention as discussed before, a transmission loss can be decreased by using a polymer of a low dielectric loss tangent and flame-retarding properties, especially, poly(phenylene oxide) having a dielectric constant at a high frequency band smaller than dielectric constants of other polymers of the low dielectric loss tangent and the flame-retarding properties, for one or both of insulations and a protective sheath of an shielded twisted pair cable. Poly(henylene oxide) is better in elongation than poly(ethersulfone) and poly(phenylene sulfide), so that an shielded twisted pair cable using poly(phenylen oxide) is improved in flexibility to provide easy installation of the cable. Further, poly(phenylene oxide) is extruded at a temperature lower than poly(ther imide) and poly(phenylene sulfide) to provide easy fabrication of an shielded twisted pair cable, and is lower in cost than poly(ether imide) and poly(phenylene sulfide).

In addition, the first feature of the invention provides the below advantages.

(1) In case where ethylene polymer is blended to polymer of a low dielectric loss tangent and flame-retarding properties, tensile elongation and extruding or forming properties are much improved without deterioration of dielectric characteristics.

(2) In case where ethylene polymer and styrene polymer are blended to polymer of a low dielectric loss tangent and flame-retarding properties, further improvement is realized in tensile elongation and extruding or forming properties.

(3) In case where flame-retarding agent is added to each composition in proportion of 1 to 300 parts by weight, fire extension speed is lowered in the vertical flame test (VTFT).

In the second and third features of the invention, siloxene-containing polymer and polymer having olefine-polymerized unit are used to improve extruding or forming properties, elongation and dielectric characteristics for poly(phenylene oxide) and aromatic ring-containing polymer of high flame-retarding properties.

In FIG. 3, there is shown the relation between tensile elongation (%) and stress (kgf/mm$^2$), wherein the stress Fo is pointed out at the tensile elongation of 2%. The inventors have found that the fluctuation of the transmission characteristics are prevented on account of pair structure deformation by laying condition when the 2% modulus is over the stress of 0.3 kgf/mm$^2$. The maximum value of the 2% modulus is preferable to be set at 50 kgf/mm$^2$ in consideration of the stiffness of an shielded twisted pair cable.

The inventors have also found that the transmission characteristics are deteriorated, as the flame-retarding properties are enhanced, and the transmission characteristics are much stabilized at a specific frequency band, when insulations and a protective sheath of an shielded twisted pair cable have a predetermined dielectric loss tangents. In more detail, the increase of a transmission loss occurring in accordance with the flame-retarding properties is suppressed, when the insulations of the unshielded twisted pair cable are formed by a composition having a dielectric loss tangent less than $1\times10^{-2}$ (1%) at a frequency of 150 MHz, and the protective sheath thereof is formed by a composition having a dielectric loss tangent less than $2\times10^{-2}$ (2%) at the same frequency.

The non-halogen flame-retarding agent is preferable to be added to each composition in proportion of 1 to 300 parts by weight, and, when it ranges out of that amount, the transmission characteristics are badly affected in the unshielded twisted pair cable.

Finally, the fourth feature of the invention will be explained.

Conventionally, a transmission loss a of a pair is expressed by the equation (1).

$$\alpha=R/2\cdot 1/Zo+Zo\cdot G/2 \quad (1)$$

where R is a high frequency resistance, G is a conductance, and Zo is a characteristic impedance.

At a high frequency of more than 4 MHz, the equation (1) is modified as the equation (2).

$$\alpha=A\cdot f^{1/2}+B\cdot f=\alpha_r+\alpha_g \quad (2)$$

where f is a frequency, A is a proportional constant (αB/km/MHz$^{1/2}$), B is a proportional constant (αB/km/MHz), $\alpha_r$ is a resistive attenuation constant, and $\alpha_g$ is a leakage attenuation constant.

The proportional constant B is expressed by the equation (3).

$$B=\pi\cdot C\cdot Zo\cdot \tan\delta \quad (3)$$

where C is a mutual static capacitance, and tanδ is an equivalent dielectric loss tangent of a composite structure comprising insulations of pairs, a protective sheath and air.

At a frequency of less than 4 MHz, or in case of using polyethylene for the insulations of the pairs and the protective sheath, the leakage attenuation constant $\alpha_g$ is approximately zero ($\alpha_g$=0). Thus, the transmission loss α is equal to the resistive attenuation-constant $\alpha_r$ ($\alpha=\alpha_r$)

However, if polyvinylchloride (PVC) is used for a protective sheath to meet the flame-retarding properties, the equivalent dielectric loss tangent tanδ, accordingly, the leakage attenuation constant $\alpha_g$ is not be negligible, because a dielectric loss tangent is approximately 100 times of a dielectric loss tangent of polyethylene. At a frequency of 30 to 60 MHz, the leakage attenuation constant $\alpha_g$ is greater than 25% of the resistive attenuationconstant $\alpha_r$.

As discussed before, a PVC protective sheath is replaced by a composition comprising polymer and a flame retarding agent in the invention. In the fourth feature of the invention, especially, the composition for a protective sheath is set to be $7\times10^{-4}$ to $7\times10^{-3}$ in dielectric loss tangent as discussed below.

Figure 4:
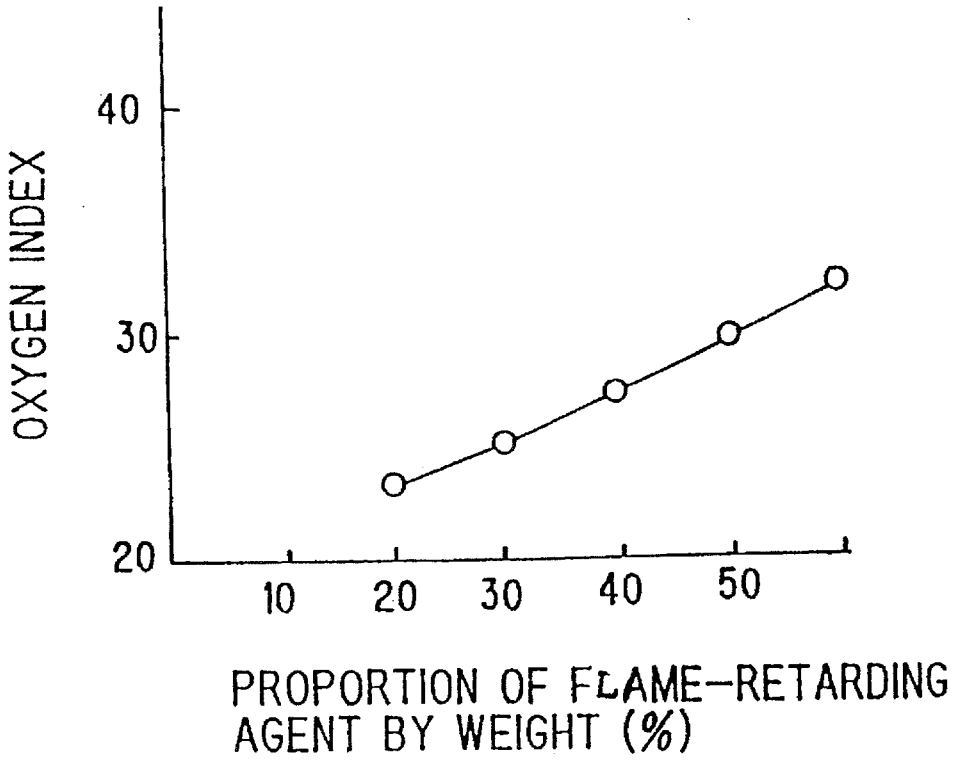
FIG. 4 is a graph showing an oxygen index relative to a proportion of a flame-retarding agent.

FIG. 4 shows a relation between a proportion of a flame-retarding agent and an oxygen index of a composition. As apparent from the relation, the oxygen index is greater than 25, when the proportion of the flame-retarding agent is approximately greater than 30%. At the same time, it is confirmed that a dielectric loss tangent of the composition is in a range of $7\times10^{-4}$ to $1.3\times10^{-3}$, when the proportion thereof is approximately greater than 30%.

In case where an outer diameter of the copper conductor 1 is 0.5 mm for the pair 2 in the unshielded twisted pair cable as shown in FIGS. 1 and 2. A will be 18.4 [A=18.4 (dB/km/MHz$^{1/2}$)] in the equation (2).

Here, if it is assumed that a characteristic impedance Zo for a pair is 100(Ω), a mutual static capacitance C is 45 (nF/km), and an equivalent dielectric loss tangent tan δ is $7\times10^{-4}$ in the equation (3), the proportional constant B will be 0.086 [B=0.086(dB/km/MHz)]. The equivalent dielectric loss tangent tan δ is approximately one tenth of a dielectric loss tangent of the composition, and is assumed here to be $7\times10^{-4}$ as explained above.

A transmission loss a of the copper conductor 1 is defined in accordance with the equation (2) by the equation (4).

$$\alpha=\alpha_r+\alpha_g=18.4f^{1/2}+0.086f \quad (4)$$

In order that the leakage attenuation constant $\alpha_g$ is negligible as compared to the resistive attenuation constant $\alpha_r$, it is necessary that a ratio of $\alpha_g/\alpha_r$ should be less than approximately 3% at a frequency of 32 MHz, and the ratio should be less than approximately 4% at a frequency of 64 MHz.

In accordance with the equation (4), the ratio is 2.6% at the frequency of 32 MHz, and is 3.7% at the frequency of 64 MHz. The results meet the above target values.

As discussed above, it is necessary that a dielectric loss tangent of a composition comprising a flame-retarding agent should be in a range of $7\times10^{-4}$ to $1.3\times10^{-3}$ to meet the flame-retarding properties. On the other hand, it is necessary that a dielectric loss tangent of the composition should be less than $7\times10^{-3}$ to negate the increase of a transmission loss caused at a frequency of more than 4 MHz by the leakage attenuation constant $\alpha_g$. Consequently, the inventors have confirmed that the flame-retarding properties and the transmission characteristics are sufficiently met, when a dielectric loss tangent of the composition is in a range of $7\times10^{-4}$ to $7\times10^{-3}$.

To be more concrete, the fourth feature of the invention will be explained in FIG. 2.

In the unshielded twisted pair cable as shown in FIG. 2, the protective sheath 3 is of a composition comprising polyethylene and a flame-retarding agent, wherein a dielectric loss tangent of the composition is set to be $7\times10^{-4}$ to $7\times10^{-3}$ and the insulation comprises a polyethylene inner layer 6 and an outer layer 7 of the composition which is the same as one for the protective sheath 3.

The flame-retarding agent is one or more of chlorine-flame-retarding agent, bromine-flame-retarding agent, decabromodiphenylether (DBDPE), tetrabromobisphenol (TBA), hexabromobenzene (HBB), etc.

The composition should have a dielectric constant of less than 2.6 to suppers a mutual static capacitance C.

In accordance with the above described structure of the unshielded twisted pair cable, flame-retarding properties and a low transmission loss at a high frequency band are obtained. At the same time, a total insulation thickness of the pairs 2 can be thin to provide an outer diameter of the unshielded twisted pair cable which is the same as an shielded twisted pair cable having a polyethylene sheath. Consequently, easy installation of the cable in a building, and low cost in manufacture are realized in the application to the TPDDI-LAN system along with the flame-retarding properties and the low transmission loss at the high frequency band.

Figure 5:
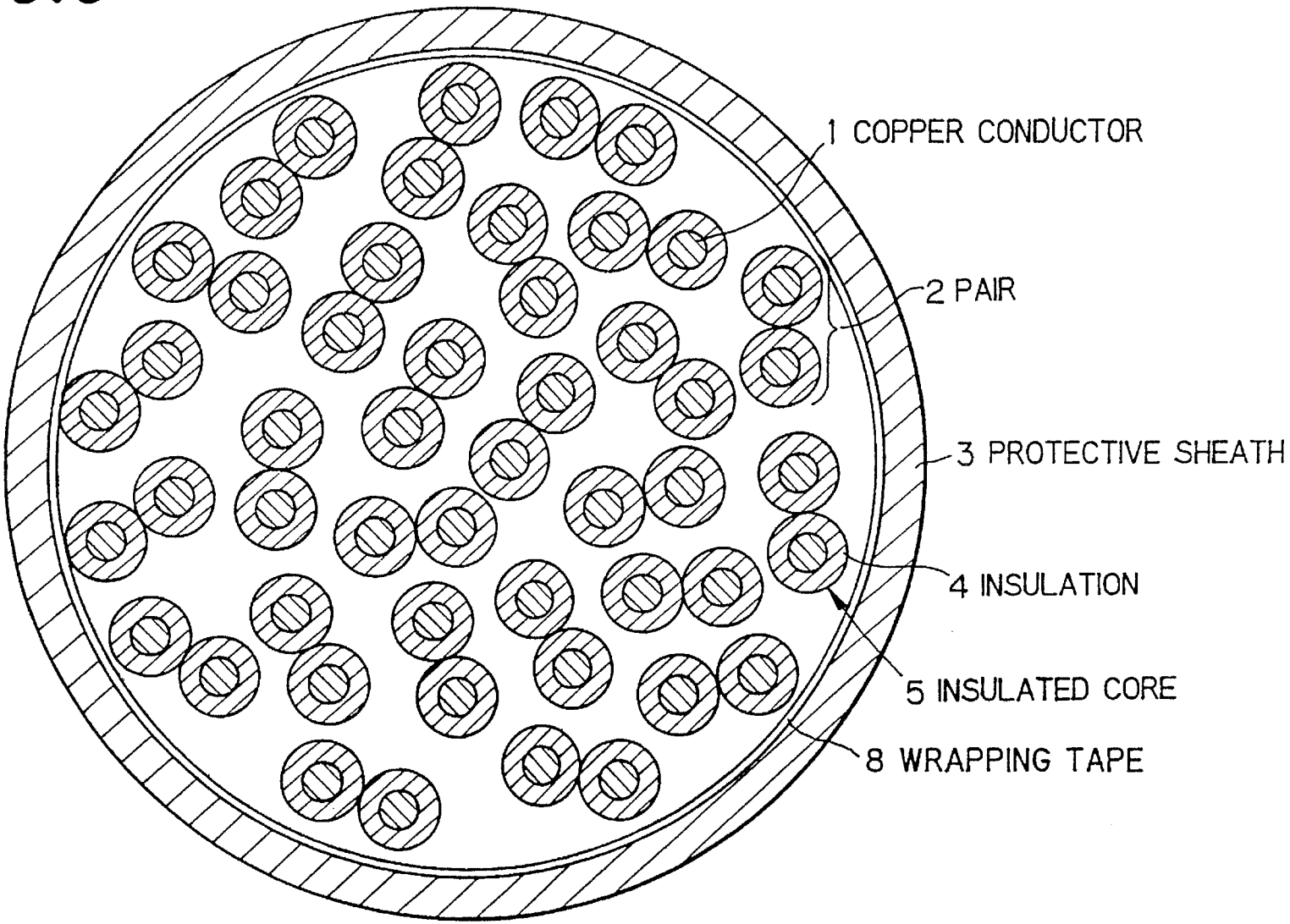
FIG. 5 is a cross-sectional view showing a third structure of an shielded twisted pair cable in which preferred embodiments according to the invention are implemented.

FIG. 5 shows a third structure of an shielded twisted pair cable, wherein like parts are indicated by like reference numerals as used in FIG. 1. In the unshielded twisted pair cable, a wrapping tape 8 which is formed to be a tape from a composition comprising polyethylene and a flame-retarding agent is used to provide flame-retarding properties and a low transmission loss at a high frequency. The composition of the wrapping tape 8 is the same as ones discussed before.

Although the invention has been described with respect to specific embodiments for complete and clear disclosure, the appended claim are not to be thus limited but are to be construed as embodying all modification and alternative construction that may occur to one skilled in the art which fairly fall within the basic teaching herein set forth.

What is claimed is:

1. An unshielded twisted pair cable, comprising:

a predetermined number of pairs stranded by a predetermined lay-length, each pair being twisted and comprising a conductor and an insulation provided to insulate said conductor, said insulation being of a composition comprising polymer of a low dielectric loss tangent and flame-retarding properties of 30 to 95 parts by weight, and ethylene polymer of 5 to 70 parts by weight at least at an outer portion thereof; and a protective sheath for covering said pairs.

2. An unshielded twisted pair cable, comprising:

a predetermined number of pairs stranded by a predetermined lay-length, each pair being twisted and comprising a conductor and an insulation provided to insulate said conductor, said insulation being of a composition comprising a mixture of 100 parts by weight, and styrene polymer of 1 to 50 parts by weight, said mixture comprising polymer of a low dielectric loss tangent and flame-retardant properties, at least at an outer portion thereof; and a protective sheath for covering said pairs.

3. An unshielded twisted pair cable, comprising:

a predetermined number of pairs stranded by a predetermined lay-length, each pair being twisted and comprising a conductor and an insulation provided to insulate said conductor, said insulation being of a composition comprising a mixture of 100 parts by weight, and a flame-retarding agent of 1 to 300 parts by weight, said mixture comprising polymer of a low dielectric loss tangent and flame-retarding properties, and ethylene polymer, at least at an outer portion thereof; and a protective sheath for covering said pairs.

4. An unshielded twisted pair cable, comprising:

a predetermined number of pairs stranded by a predetermined lay-length, each pair being twisted and comprising a conductor and an insulation provided to insulate said conductor, said insulation being of a composition comprising a mixture of 100 parts by weight, styrene polymer of 1 to 50 parts by weight, and a flame-retarding agent of 1 to 300 parts by weight, said mixture comprising polymer of a low dielectric loss tangent and flame-retarding properties and ethylene polymer, at least at an outer portion thereof; and a protective sheath for covering said pairs.

5. An unshielded twisted pair cable, comprising:

a predetermined number of pairs stranded by a predetermined lay-length, each pair being twisted and comprising a conductor and a thermoplastic insulation provided to insulate said conductor, said insulation having a dielectric loss tangent of less than $1\times10^{-2}$ at a frequency of 150 MHz and a 2% modulus of at least 0.3 $kgf/mm^2$; and a protective sheath for covering said pairs.

6. An unshielded twisted pair cable, comprising:

a predetermined number of pairs stranded by a predetermined lay-length, each pair being twisted and comprising a conductor and a thermoplastic insulation provided to insulate said conductor, said insulation including at least one layer of non-halogen flame-retarding composition, and having a dielectric loss tangent of less than $1\times10^{-2}$ at a frequency of 150 MHz and a 2% modulus of at least 0.3 kgf/mm$^2$; and a protective sheath for covering said pairs.

7. The cable as defined in claim 6, wherein:

said insulation includes a plurality of layers, some of which are not of said non-halogen flame-retarding composition.

8. The cable as defined in claim 6, wherein:

said protective sheath is of non-halogen flame-retarding composition having a dielectric loss tangent of less than $2\times10^{-2}$ at a frequency of 150 MHz.

9. The cable as defined in claim 6, wherein:

said non-halogen flame-retarding composition includes a mixture in which at least one of a polymer having an olefine polymerized unit in its main chain and a polymer having a siloxene bond in its main chain, is blended to poly(phenylene oxide).

10. The cable as defined in claim 8, wherein:

said non-halogen flame-retarding composition includes a mixture in which at least one of a polymer having olefine polymerized unit in its main chain and a polymer having a siloxene bond in its main chain is blended to poly(phenylene oxide), said mixture being 100 parts by weight, and non-halogen flame-retarding agent of 1 to 300 parts by weight.

11. The cable as defined in claim 6, wherein:

said non-halogen flame-retarding composition includes a mixture in which at least one of a polymer having an olefine polymerized unit in its main chain and a polymer having a siloxene bond in its main chain is blended to a polymer having an aromatic ring in its main chain.

12. The cable as defined in claim 6, wherein:

said non-halogen flame-retarding composition includes a mixture in which at least one of a polymer having an olefine-polymerized unit in its main chain and a polymer having siloxene bond in its main chain is blended to a polymer having an aromatic ring in its main chain, said mixture being 100 parts by weight, and non-halogen flame-retarding agent of 1 to 300 parts by weight.

13. The cable as defined in claim 6, wherein:

said non-halogen flame-retarding composition, includes polymer having an olefine-polymerized unit in its main chain, said polymer being 100 parts by weight, and non-halogen flame-retarding agent of 1 to 300 parts by weight.

14. An unshielded twisted pair cable, comprising:

a predetermined number of pairs stranded by a predetermined lay-length, each pair being twisted and comprising a conductor and an insulation provided to insulate said conductor; and a protective sheath for covering said pairs, said protective sheath being of a composition comprising polymer and a flame-retarding agent, said composition having a dielectric loss tangent of $7\times10^{-4}$ to $7\times10^{-3}$.

15. The cable as defined in claim 14, wherein:

said insulation is of a composition including polymer and a flame-retarding agent at least at an outer portion thereof, said composition having a dielectric loss tangent of $7\times10^{-4}$ to $7\times10^{-3}$.

16. The cable as defined in claim 14, further comprising:

a wrapping tape for wrapping said pairs to be covered by said protective sheath, said wrapping tape being of a composition comprising polymer and a flame-retarding agent, said composition having a dielectric loss tangent of $7\times10^{-4}$ to $7\times10^{-3}$.

* * * * *